US009125450B2

(12) United States Patent
Zhao et al.

(10) Patent No.: US 9,125,450 B2
(45) Date of Patent: Sep. 8, 2015

(54) INDEPENDENT HARNESS SYSTEM FOR A SOFT BOOT

(75) Inventors: Alex Zhao, Tustin, CA (US); Susanne Dachgruber, Capistrano Beach, CA (US); Lucien Vink, San Clemente, CA (US)

(73) Assignee: Flow Sports, Inc., San Clemente, CA (US)

( * ) Notice: Subject to any disclaimer, the term of this patent is extended or adjusted under 35 U.S.C. 154(b) by 438 days.

(21) Appl. No.: 13/315,204

(22) Filed: Dec. 8, 2011

(65) Prior Publication Data

US 2012/0144700 A1 Jun. 14, 2012

Related U.S. Application Data

(60) Provisional application No. 61/421,590, filed on Dec. 9, 2010, provisional application No. 61/529,763, filed on Aug. 31, 2011.

(51) Int. Cl.

| | |
|---|---|
| ***A43B 3/02*** | (2006.01) |
| ***A43B 5/04*** | (2006.01) |
| ***A43C 1/00*** | (2006.01) |
| ***A43C 7/00*** | (2006.01) |

(52) U.S. Cl.

CPC ..... *A43B 5/0405* (2013.01); *A43B 5/0401* (2013.01); *A43C 1/00* (2013.01); *A43C 7/00* (2013.01)

(58) Field of Classification Search

CPC ..... A43B 5/0401; A43B 5/0405; A43B 5/04; A43C 7/00; A43C 1/009

USPC ..... 36/117.6, 117.9, 114, 115, 50.5

See application file for complete search history.

(56) References Cited

U.S. PATENT DOCUMENTS

| | | | | |
|---|---|---|---|---|
| 5,566,474 | A * | 10/1996 | Leick et al. | 36/50.1 |
| 6,405,457 | B1 * | 6/2002 | Basso et al. | 36/89 |
| 6,467,195 | B2 * | 10/2002 | Pierre et al. | 36/50.5 |
| 6,792,702 | B2 * | 9/2004 | Borsoi et al. | 36/117.6 |
| 7,086,181 | B2 * | 8/2006 | Farys | 36/50.5 |
| 7,159,340 | B2 * | 1/2007 | Borsoi | 36/50.1 |
| 7,281,341 | B2 * | 10/2007 | Reagan et al. | 36/50.1 |
| 7,386,947 | B2 | 6/2008 | Martin et al. | |
| 7,428,789 | B2 * | 9/2008 | Holzer et al. | 36/88 |
| 7,735,242 | B2 * | 6/2010 | Seliger et al. | 36/50.5 |
| 7,841,106 | B2 * | 11/2010 | Farys | 36/50.1 |
| 8,474,157 | B2 * | 7/2013 | Motawi et al. | 36/117.1 |
| 2002/0050076 | A1 | 5/2002 | Borsoi et al. | |
| 2004/0074110 | A1 | 4/2004 | Borsoi | |
| 2004/0250452 | A1 | 12/2004 | Farys | |
| 2005/0126043 | A1 | 6/2005 | Reagan et al. | |
| 2006/0196083 | A1 | 9/2006 | Martin et al. | |
| 2010/0101114 | A1 | 4/2010 | Reagan et al. | |

* cited by examiner

*Primary Examiner* — Jila M Mohandesi

(74) *Attorney, Agent, or Firm* — Fred C. Hernandez; Mintz Levin Cohn Ferris Glovsky and Popeo, P.C.

(57) ABSTRACT

Disclosed is a boot system having an outer boot including a securing system and a superior end that includes a cuff; an inner boot sized to fit between the outer boot and a foot area of a user inserted in the boot system; and a harness system having a flexible panel and a lace slidably engaged with the panel. The inner boot includes a tension capture element coupled adjacent to a superior end of the inner boot. The harness system is removably secured to the outer boot.

21 Claims, 12 Drawing Sheets

INDEPENDENT HARNESS SYSTEM FOR A SOFT BOOT

CROSS REFERENCE TO RELATED APPLICATIONS

This application is related to and claims the benefit of priority under 35 U.S.C. 119(e) of U.S. Provisional Application Ser. No. 61/421,590, titled, "Independent Harness System for a Soft Boot," filed Dec. 9, 2010 and U.S. Provisional Application Ser. No. 61/529,763, titled, "Independent Harness System for a Soft Boot," filed Aug. 31, 2011. Priority of the filing date of Dec. 9, 2010 is hereby claimed, and the disclosure of the provisional patent application is hereby incorporated by reference in its entirety.

BACKGROUND

Some boots worn by users can include an inner liner or inner boot that fits between an outer boot and the user's foot. In general, the inner boot may generally conform to the shape of the user's foot to at least provide some flexible support. Furthermore, an inner boot can assist in keeping a user's foot warm, provide padding, and absorb moisture in the boot. In addition, the inner boot can include a lacing or securing system that allows a user to customize the fit of the inner boot against the user's foot. The securing system of the inner boot can be separate and distinct from any securing mechanisms used to secure the outer boot. Furthermore, the securing system of the inner boot may be covered and protected by the outer boot, particularly when the outer boot securing system is tightened.

In sporting activities, for example snowboarding, skiing, hiking, skating, and the like, the one or more securing mechanisms of the boot can change over time with repeated flexion of the inner and outer boots during use. This can result in the boot feeling looser than the original fitting set by the user. Alternatively, a user can determine during use that the original fitting of the boot was secured too tight and would prefer the fit to be looser. In addition, the user may determine that only the inner boot fitting is in need of adjustment and not the outer boot. In this particular circumstance, some currently available boots generally require the outer boot to be loosened in order to access and adjust the securing mechanism of the inner boot to adjust the inner boot fitting. However, loosening the outer boot to adjust the fitting of the inner boot can be inconvenient and/or unfavorable for the user, particularly in harsh weather conditions.

For example, a snowboarder who wants to tighten the securing mechanism of the inner boot may have to sit down and remove one or more gloves in order to loosen the outer boot to expose and adjust the inner boot securing mechanism. This can undesirably allow heat to escape from inside the boot and from the user's hands. In addition, these additional steps just to access the inner boot securing mechanism can unnecessarily prolong the time a user is exposed to harsh conditions in a less protected and stationary state. Therefore, it would be beneficial to have a boot that allows a user to customize the fit of the inner boot without requiring the outer boot to be loosened and/or the user's gloves to be removed.

SUMMARY

Described herein are boot systems that can generally provide at least compression and stability to the foot, ankle and lower leg of a user. The boot system can have boot layers that can each be independently adjusted in order to increase or decrease the compression and stability provided to the user by the boot system to achieve a desired fit. The boot systems described herein include features that allow a user to independently adjust one or more securing mechanisms of the boot system to provide the user with a customized fit, as will be described in detail below.

In one aspect, there is disclosed a boot system having an outer boot including a securing system and a superior end that includes a cuff; an inner boot sized to fit between the outer boot and a foot area of a user inserted in the boot system, and a harness system having a flexible panel and a lace slidably engaged with the panel. The inner boot includes a tension capture element coupled adjacent to a superior end of the inner boot. The harness system is removably secured to the outer boot.

The harness system can be removably secured to at least a part of the inner boot. The panel of the harness system can wrap about at least a part of the inner boot. The harness system can provide variable amounts of compression around the at least a part of the inner boot upon sliding engagement of the lace with the panel. The panel can discontinuously wrap about the at least a part of the inner boot and forms at least one gap in the panel. The harness system can include a first lacing element disposed on a first side of the at least one gap and a second lacing element disposed on a second, opposite side of the at least one gap. The first and second lacing elements can have an alignment that is horizontally off-set. The lace can extend sequentially through the first and second lacing elements and form a zigzag configuration relative to the panel. Application of tension to the lace can force the at least one gap to narrow.

The harness system further can include a third lacing element disposed on the first side of the at least one gap and a fourth lacing element disposed on the second, opposite side of the at least one gap. The third and fourth lacing elements can have an alignment that is horizontally off-set from one another and from the first and second lacing elements. The lace can extend sequentially through the third and fourth lacing elements and form a zigzag configuration relative to the panel. Application of tension to the lace can force the at least one gap to narrow. The lace can include a single looped lace anchored to the panel at a first end and anchored to the panel at a second, opposite end forming a first lace portion and a second lace portion. The first lace portion can force an upper portion of the at least one gap to narrow and the second lace portion can force a lower portion of the at least one gap to narrow. The single looped lace can loop through a handle at a superior end of the harness system. Distal regions of the first and second lace portions can extend through and can be releasably secured to a portion of the tension capture element. The tension capture element can include a first and a second tightening track. The first tightening track can capture the first lace portion and the second tightening track can capture the second lace portion. The first and second tightening tracks can be molded into a single tension capture element. The single tension capture element can be coupled to the inner boot by at least one fixation element extending through a corresponding aperture. The tension capture element coupled adjacent to a superior end of the inner boot can be positioned on at least one of a medial side and a lateral side of the inner boot. The tension capture element can be accessible external to the outer boot without adjusting the securing system of the outer boot. Other features and advantages should be apparent from the following description of various embodiments, which illustrate, by way of example, the principles of the disclosed systems.

DETAILED DESCRIPTION

Described herein is a boot system that includes more than one boot layer that can, independently and in combination, generally provide at least compression and stability to the foot, ankle and lower leg of a user. In addition, each boot layer can at least be capable of being independently adjusted in order to increase or decrease the compression and stability provided to the user by the boot system to achieve a desired fit. The boot systems described herein include features that allow a user to independently adjust one or more securing mechanisms of the boot system to provide the user with a customized fit, as will be described in detail below. The boot systems described herein can include a sports boot that allows a user's foot to be inserted and secured in the boot system. In addition, some embodiments of the boot system can be used with an external appliance, such as a snowboard, wakeboard, snowshoe, roller or ice skating appliance, or any other appliance that can couple to the boot system described herein. In addition, the boot system can include features that further assist the boot system to be used with at least the external appliances listed herein. It should also be appreciated that the boot system described herein can be used for other activities such as hiking.

Figure 1:
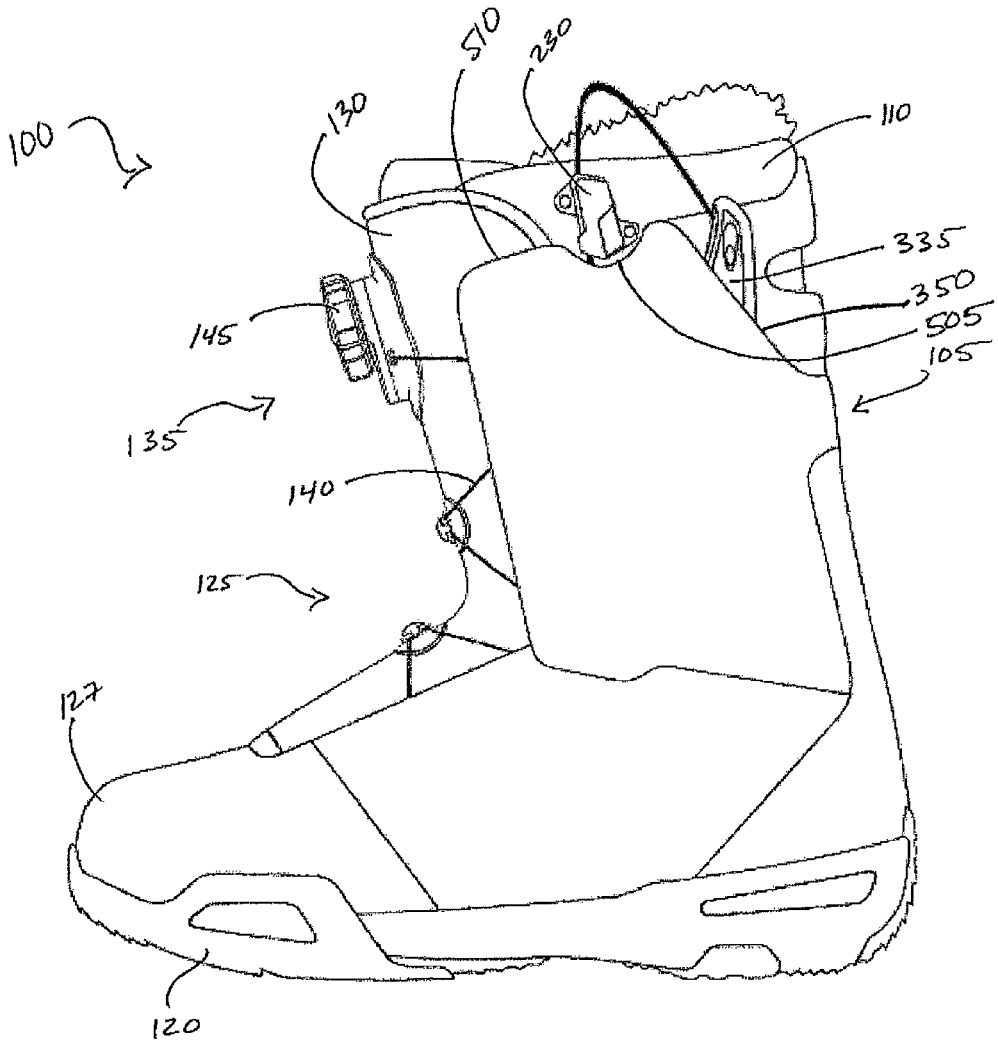
FIG. 1 shows a medial side view of an embodiment of a boot system.

Turning now to the figures, FIG. 1 shows an embodiment of a boot system 100. The boot system 100 can include an outer boot 105 and an inner boot 110 with the inner boot 110 generally sized and shaped such that it can fit within, and be removed from, the outer boot 105. In general, the outer boot 105 is designed and manufactured to be less flexible and more durable than the inner boot 110. More specifically, the outer boot 105 generally provides a majority of the structural support and protection from the environment (i.e., moisture, extreme temperatures, rough terrain, etc.) than the inner boot 110. In contrast, the inner boot 110 is generally designed and manufactured to be more flexible and provide generally comfortable compression and flexible support around the user's foot area (i.e., foot, ankle, lower leg). Therefore, the combination of the outer boot 105 and inner boot 110 of the boot system 100 can provide a user with protection and at least some stability and flexibility. As will be described in further detail below, a user can adjust the fitting of the boot system 100 to generally customize at least the compression, stability, and comfort the boot system provides the user.

The outer boot 105 can include an outsole 120 and an outer boot upper 125 securely mounted above the outsole 120. The outsole 120 generally functions to provide comfort and protection along the bottom of the outer boot 105. In addition the outsole 120 can include features that assist in coupling the outer boot 105 to an external appliance. Furthermore, the outsole 120 can be made out of a material that can provide for comfortable walking and protects a user from harsh environments and conditions. For example, the outsole 120 can be made out of a type of rubber that can withstand extreme temperatures, repel moisture, and is advantageous for walking. However, the outsole 120 material is not limited to being made out of a rubber and can be made from any material or combination of materials without departing from the scope of this disclosure. In addition, the outsole 120 can include surface features that can provide at least some traction for the user while walking on potentially slippery surfaces.

Some embodiments of the outer boot upper 125 can include a pair of closure flaps surrounding a space that generally extends from adjacent the toe 127 area to the cuff 510 of the outer boot upper 125. In addition, the closure flaps can at least partially cover a tongue 130 that generally extends at least partially along and within the space. More specifically, the tongue 130 can generally extend from adjacent the toe 127 area of the outer boot upper 125 to the superior end of the outer boot upper 125. In addition, the tongue 130 can be made from generally the same material as the outer boot upper 125, or the tongue 130 can be made from any number of various other materials without departing from the scope of this disclosure. For example, the outer boot upper 125 can be made out of one or more of a nylon, polyester polyurethane, Polyvinyl chloride (PVC), leather, textile, mesh, and synthetic leathers. By way of further example, the tongue 130 can be made out of one or more of a nylon, polyester polyurethane, PVC, textile, and mesh.

In some embodiments of the outer boot upper 125, the toe 127 can be molded during manufacturing in order to achieve a desired look and feel of the toe 127 that would otherwise be difficult to achieve by other manufacturing processes. In particular, molding the toe 127 of the outer boot upper 125 during manufacturing allows the toe 127 to have a generally rounded shape. A rounded toe 127 allows for additional room in the toe area for the user's toes and any surrounding material (i.e., socks, inner boot, etc.). The rounded toe area can provide added comfort for the user and relieve any undesired pressure. In addition, molding the toe 127 during manufacturing also provides for a lighter weight outer boot upper 125. Alternatively, a rounded toe 127 can be achieved by placing additional support material (i.e., metal, molded plastic, etc.) and forming the outer boot upper 125 material around the support material. In addition, molding the toe 127 of the outer boot upper 125 allows the toe 127 to be stiff and durable, which can allow the shape and integrity of the toe 127 to be generally maintained.

In some embodiments of the boot system 100, the outer boot upper 125 can include at least one securing system 135. The securing system 135 can function to at least increase or decrease the support provided by the outer boot upper 125 to a user. As shown in FIG. 1, the securing system 135 can include a cable or outer lace 140 and a tightening mechanism 145. The outer lace 140 can be slidably disposed or threaded through the outer boot upper 125 and attached to a part of the tightening mechanism 145. It should be appreciated that the outer boot 105 can be used with various types of securing systems and need not include a tightening mechanism 145. In addition, the outer lace 140 can be threaded through a plurality of loops, hooks, or other features that allow the one or more outer laces 140 to be secured to the outer boot 105. It should be appreciated that as used herein, lace or outer lace can refer to any elongate, flexible element that can be used to at least tighten or compress a portion of the boot system 100. Furthermore, the lace can be any suitable material (i.e., leather, metal, cloth, plastic, etc.) without departing from the scope of this disclosure.

Figure 2:
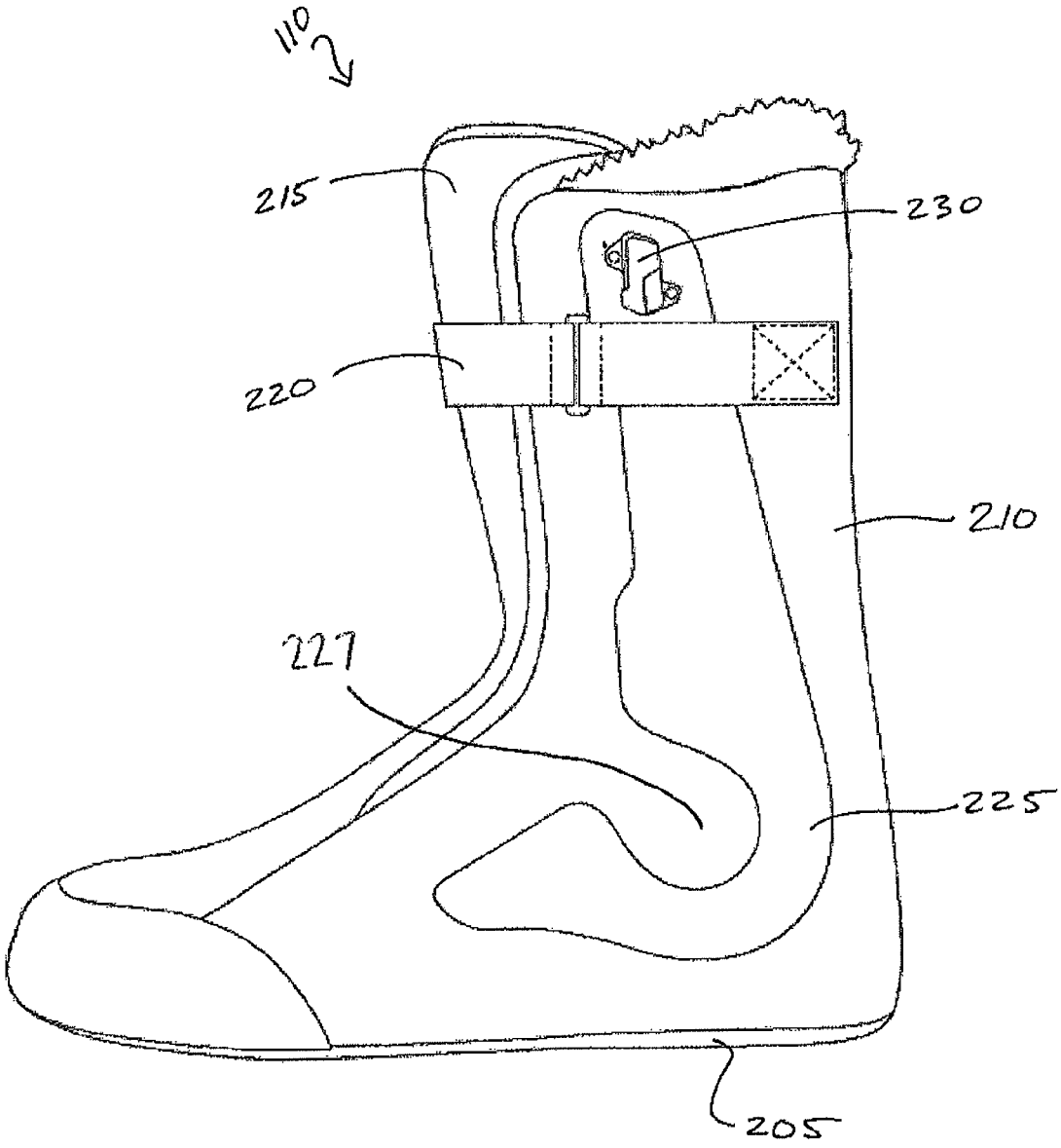
FIG. 2 shows a medial side view of the inner boot from FIG. 1.
Figure 3:
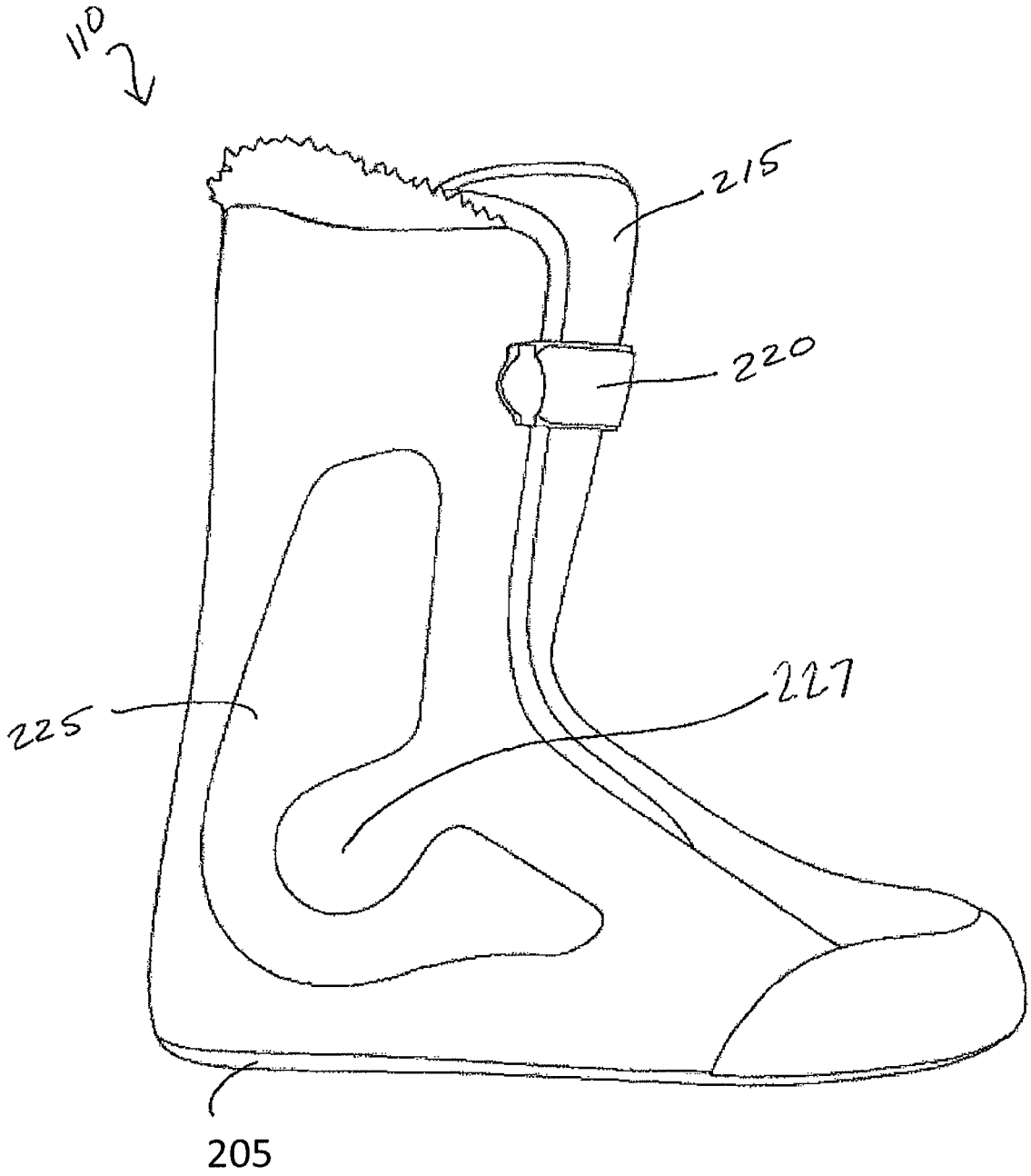
FIG. 3 shows a lateral side view of the inner boot from FIG. 1.

FIGS. 2-3 illustrate an embodiment of a liner or inner boot 110. The inner boot 110 can be generally sized and shaped such that it can be removably inserted into the outer boot 105 and can generally fit snuggly within the outer boot 105. In addition, the inner boot 110 can be designed to generally conform to the foot area of a user in order for the boot system 100 to provide a user with a generally comfortable and secure fit. The inner boot 110 can include a sole 205 and an inner boot upper 210. The sole 205 can be flexible and somewhat rugged, and can be made out of one or more of the same materials as the inner boot upper 210 or the sole 205 can be made out of one or more materials different from the inner boot upper 210. The inner boot upper 210 can be generally soft and flexible and can be made out of one or more materials including ethylene vinyl acetate (EVA), polyethylene (PE) foam, polyurethane (PU), textiles (such as Nylon and polyester), and various plastics and synthetic materials. For example, the sole 205 can be made out of EVA, nylon mesh, and/or heat treated foam and can have a textured outer surface in order to assist in preventing sliding between the sole 205 and the outer boot 105. However, the sole 205 and inner boot upper 210 can be made out of generally any number of a variety of materials without departing from the scope of this disclosure.

As described above, the outer boot 105 can generally provide the structural support and protection of the boot system 100, and the inner boot 110 can generally provide the contoured support around a user's foot area. In addition, the inner boot 110 can also provide at least some insulation, moisture absorption, and shock absorption. The inner boot 110 can include a middle panel 215 that can be flexible and/or movable that allows the inner boot 110 to expand and accept at least a user's foot. In addition, the inner boot 110 can include an adjustable strap 220 that surrounds at least a part of the generally superior end or cuff of the inner boot 110. As shown in FIG. 2, the strap 220 can be secured to the inner boot 110 such that adjusting the strap 220 can vary the compression and fit of at least the superior end of the inner boot 110 for a user. In addition, the strap 220 can be any number of adjustable securing elements and is not to be limited to a strap 220. Furthermore, the strap 220 can include adjustable features such as Velcro® (hook and loop fasteners), and can be guided at least partially through a D-ring or other element that is generally affixed to the inner boot 110.

In addition, and as shown in FIG. 2, the inner boot 110 can include a reinforcement panel 225. The reinforcement panel 225 can be positioned on the medial (as shown in FIG. 3) and/or lateral side of the inner boot 110 and can provide some support for the inner boot 110. The reinforcement panel 225 can allow for the secure attachment of one or more features to be attached to the inner boot 110. As shown in FIG. 2, the reinforcement panel 225 can extend generally the height of the inner boot 110 (i.e., from approximately the cuff to approximately the sole 205) and can additionally extend generally parallel to the sole 205. The reinforcement panel 225 can include cut-outs and can be made out of a variety of materials in order to provide support while generally not creating any discomfort to the user due to its presence in the boot system 100. For example, the reinforcement panel 225 can be cut-out in the general area of where a user's ankle may be positioned when secured in the boot system 100. An ankle area cut-out 227 in the reinforcement panel 225 can prevent uncomfortable pressure to a user's ankle, particularly where parts of bone tend to protrude. A reinforcement panel 225 can be made out of one or more materials and can be molded or hot melted directly onto the inner boot 110 during manufacturing. For example, the reinforcement panel 225 can be made out of one or more of an ethylene vinyl acetate (EVA), polyethylene (PE) foam, polyurethane (PU), synthetic foams, plastic sheets or any number of materials appropriate for providing stability for the inner boot 110. The reinforcement panel is generally manufactured of a material that is at least a rigid as the inner boot material.

Figure 4:
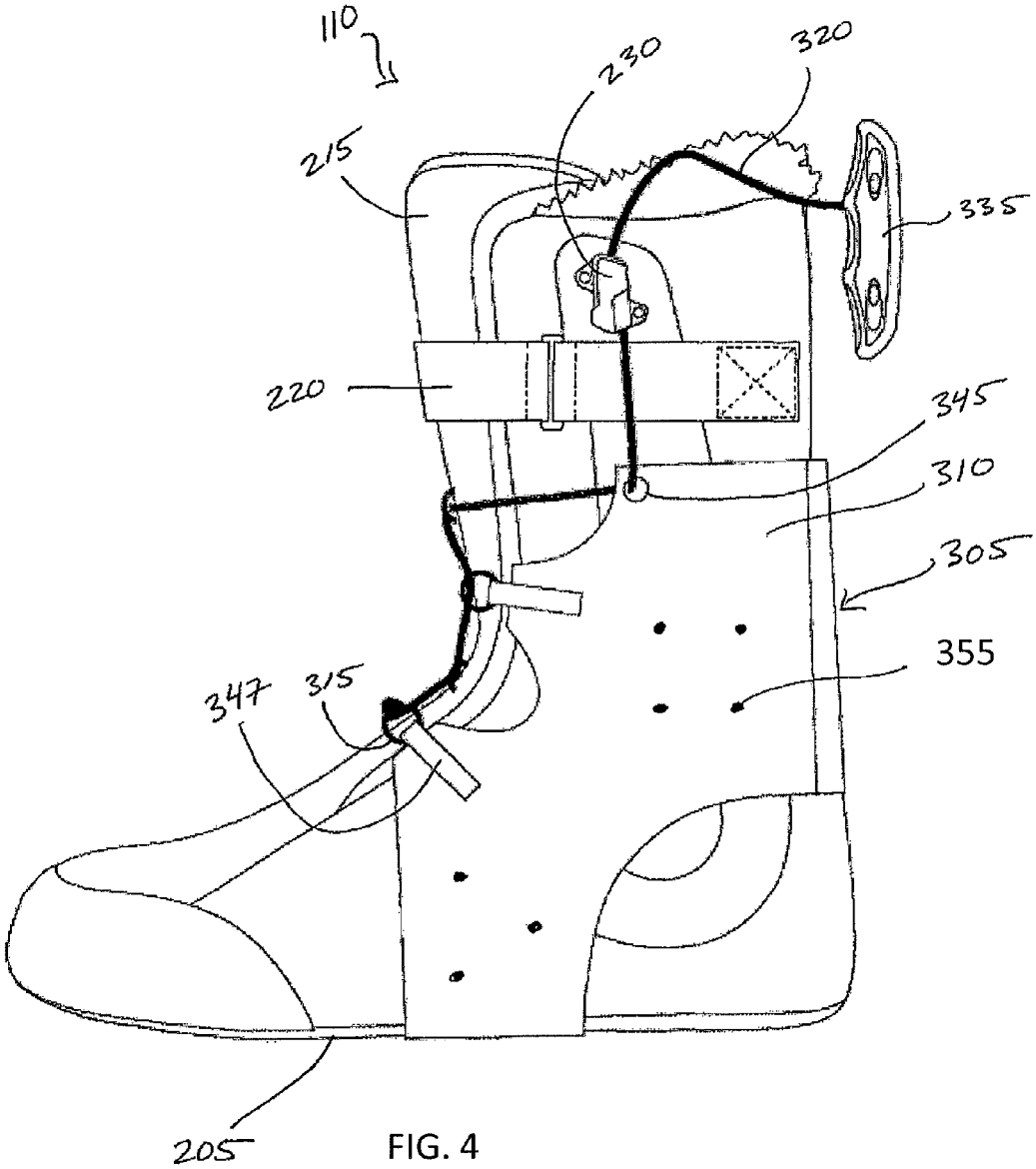
FIG. 4 shows a medial side view of an embodiment of a harness system surrounding the inner boot from FIG. 2.
Figure 5:
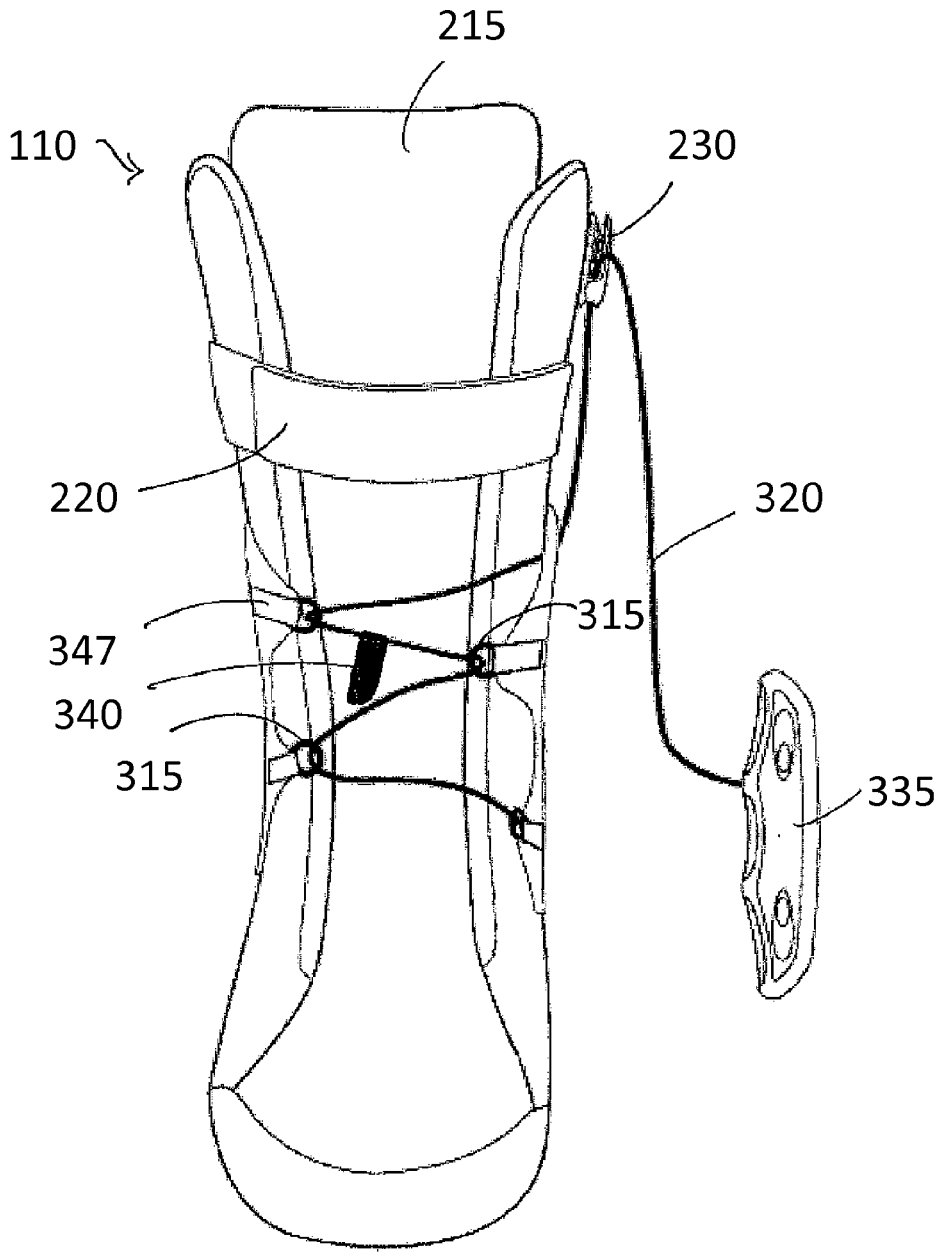
FIG. 5 shows a front view of the harness system of FIG. 3.

FIGS. 4-5 illustrate an embodiment of a harness system 305. In some embodiments of the boot system 100, the harness system 305 can assist a user in achieving a desired fit (i.e., compression, support) of the inner boot 110 generally around at least a part of the user's foot area. For instance, the harness system 305 can be flexible and generally sized and shaped such that it is able to conform to at least a part of the inner boot 110 in order to apply an amount of compression to achieve a desired fit for a user. Furthermore, the harness system 305 can include one or more features that allow a user to vary the amount of compression applied by the harness system 305, as will be discussed in detail below. In addition, the harness system 305 allows a user to vary the fit of the inner boot 110 without disrupting the outer boot 105 securing system 135, as will also be discussed in further detail below.

In general the harness system 305 can be a separate entity from the inner boot 110 and/or outer boot 105 that can be removably secured to either or both of the inner boot and the outer boot. The harness system 305 can be removably secured to one or more parts of the boot system 100 in order to at least assist in generally securing the position of the harness system 305 within the boot system 100. For example, the harness system 305 can include one or more reversible attachment features, such as Velcro® (hook and loop fasteners), that can mate with one or more complementary attachment features on the inner boot 110 to removably secure positioning of the harness system 305 relative to the inner boot 110. Similarly, the harness system 305 can include one or more attachment features that can mate with one or more complementary attachment features of the outer boot 105 to generally secure positioning of the harness system 305 relative to the outer boot 105.

In an embodiment, the harness system 305 can include one or more Velcro® panels along the inner back side of the harness system 305 that can mate with one or more complementary Velcro® panels located along the outer back side of the inner boot 110. In another embodiment, the harness system 305 can include one or more Velcro® panels along an inner surface of the bottom side that can mate with one or more complementary Velcro® panels located along the underside of the inner boot 110. In an embodiment, the harness system 305 can include one or more Velcro® panels along the outer back side of the harness system 305 in order to mate with one or more complementary Velcro® panels located along the inner back side of the outer boot 105. In another embodiment, the harness system 305 can include one or more Velcro® panels along an outer surface of the bottom side that can mate with one or more complementary Velcro® panels located along the inner bottom surface of the outer boot 105. However, any number of attachment features can be positioned along any part of the harness system 305 that can attach to any number of complementary attachment features located within the boot system 100 without departing from the scope of this disclosure. It should be appreciated also that the attachment features can vary and is not limited to Velcro® panels.

Some embodiments of the harness system 305 can include a panel 310, a plurality of lacing elements 315, and one or more laces 320. As shown in FIG. 4, the panel 310 can be sized and shaped such that when it is positioned for use around the inner boot 110, the panel 310 extends from approximately the arch area under the foot to along the medial and lateral sides of the inner boot 110, and then wraps around the back side of the inner boot 110. In addition, the panel 310 can be shaped so that at least during use the material of the panel 310 does not bunch up or overlap. For example, the panel 310 can be cut out in areas where material could potentially bunch up and form unwanted pressure points. By way of further example, the heel and parts of the panel 310 that cover the front area of the foot during use can be removed. Furthermore, generally any features attached to the panel 310 (i.e., lacing elements 315) can be positioned and oriented relative to each other such that they are not forced to overlap during use in order to prevent unwanted pressure points. It should be appreciated that the panel 310 need not be discontinuous and can have a complete boot-shape with one or more flexible portions such that the inner boot 110 can be inserted into and be received by the panel 310. In general, the panel 310 can be sized and shaped in any number of ways that allow the harness system 305 to assist the inner boot 110 by providing variable amounts of compression around at least a part of the inner boot and the user's foot area.

Some embodiments of the panel 310 of the harness system 305 can include an inner surface covered at least in part with one or more gel-reinforced inner cushion features 355. For example, the gel-reinforced inner cushion features 355 can include an array of gel-like cushions that can be made out of a material such as SEBS (styrene ethylene butadiene styrene) polymers, TPU (thermoplastic polyurethane), and polyurethane heat treated gels and injected bladders. However, any variety of materials that provide a cushioning effect can be used without departing from the scope of the disclosure. The cushion features 355 can be molded onto the fabric in discrete locations of the panel 310 to provide generalized dampening and pressure reduction. For instance, the lacing system 135 of the outer boot 105 can cause pressure points against the side of the foot. The cushions 355 can be molded onto the fabric of the panel 310 such that they protect the foot from these pressure points. The cushions 355 can also provide some degree of grip to the underlying portion of the inner boot 110 as the harness system 305 is tightened around the inner boot 110.

The panel 310 material can be generally lightweight, breathable and inelastic. Additionally, the material of the lace 320 can be made out a variety of materials including various metals (i.e., stainless steel cord), leather, cloth, plastic, braided fibers, and the like. The lacing elements 315 are shown as o-rings, but need not be any particular size and/or shape. The lacing elements 315 can be configured such that they slidably receive the lace 320 therethrough such that the lace 320 can be in sliding engagement with the lacing elements 315 of the panel 310 to provide variable amounts of compression around at least a part of the inner boot. The lacing elements 315 can be manufactured out of a material, such as a metal, that can minimize friction between the lace 320 and the panel 310 such that the lace 320 can easily slide therethrough.

As illustrated in FIG. 5, in one embodiment the harness system 305 can include a panel 310 that generally wraps around at least a portion of the inner boot 110. The panel 310 can wrap discontinuously around the inner boot 110 such that one or more gaps are created. In an embodiment, the panel 310 wraps around the inner boot 110 and leaves a gap along the front of the inner boot 110 between opposing sides of the panel 310. In this configuration, the plurality of lacing elements 315 can be positioned near an edge of the opposing sides of the panel 310 along the gap. The lacing elements 315 on either side of the gap can be positioned in direct opposition to one another or the lacing elements 315 can be positioned in a horizontally off-set manner. When the lace 320 extends sequentially through the plurality of lacing elements 315, the lace 320 can form a zigzag configuration or pattern relative to the panel 310. In an embodiment, the harness system 305 includes a single lace 320 that is affixed at its distal and to the panel 310 and extends through at least one lacing element 315 on an opposite side of the gap. In addition, each lacing element 315 can be affixed to the panel 310 so that as the lace 320 is brought under increased tension, the harness system 305 is able to apply generally increased amounts of compression to the inner boot 110.

In an embodiment, the harness system 305 includes a single lace 320 having a zigzag lacing configuration that allows an even closing or narrowing of the gap between the opposing sides of the panel 310 as the lace 320 is placed under tension, or increasing tension. The single-lace embodiment of the harness system 305 can prevent lace cross-over points that can create pressure points and can increase the friction along each lace such that loosening and tightening the lace to the desired tension is more difficult, if not impossible, without first loosening one or more cross-over points. It should be appreciated, however, that any number of laces 320 can be used with the harness systems described herein without departing from the scope of the disclosure.

As mentioned above, FIG. 5 illustrates an embodiment of a lacing configuration of the harness system 305 that includes a single lace 320 and a plurality of lacing elements 315 secured in an off-set manner along the opposing sides of the panel 310. In addition, the distal end of the lace 320 can be fixedly attached to the panel 310 generally adjacent the lower end of one side of the panel 310. From this attachment point, the lace 320 can extend across the gap between the opposing sides of the panel 310 and loop through a first lacing element 315. The lace 320 can continue to sequentially loop through the lacing elements 315 on either side of the gap such that the lace 320 forms a zigzag configuration across the front side of the inner boot 110, as shown in FIG. 5. In addition, this configuration allows the lace 320 to force the opposing ends of the panel 310 towards each other when the lace 320 is placed under tension.

A user can apply tension to the lace 320 which can force the lace 320 to pull the lacing elements 315 on either side of the gap towards each other. The lacing elements 315 can be securely attached along the opposing sides of the panel 310 (either directly opposite or in an off-set arrangement) and the gap can narrow or close as the lacing elements 315 are forced towards each other. As the gap narrows or closes, the harness system 305 can increasingly apply compression to the inner boot 110. Therefore, a user can adjust the fit of the inner boot 110 to the user's foot area by pulling on the lace 320, or increasing the tension of the lace 320 of the harness system 305. Additionally, the lace 320 can include a pull tab 340 coupled to at least a portion of the lace 320 that can assist a user in releasing tension on the lace 320. The pull tab 340 can be sized and shaped such that a user can easily grasp and pull the pull tab 340 without needing to remove one or more gloves.

A reinforcement feature 347 (see FIG. 4) can at least assist in securing the attachment of one or more of the lacing elements 315 to the panel 310. The reinforcement feature 347 can be made out of a material that is more durable and less prone to tearing than the material used for the panel 310. For example, the panel 310 can be made out of one or more materials that are generally light weight, breathable, and non-elastic, which can include one or more of a double stitched non-woven material, storable board material, textile, nylon, polyester or plastic sheets. The material used for the reinforcement feature 347 can include at least one of a nylon webbing, metal rings, plastic hooks, molded parts, and stitched panels which may or may not be suitable material for the panel 310. However, both the reinforcement feature 347 and the panel 310 can be made out of any number of various materials not listed herein without departing from the scope of this disclosure.

The lace 320 can be captured by one or more tension capture elements 230, such as a lace cleat. The tension capture elements 230 can be used to secure tension of the lace 320 or other securing features of the harness system 305. The tension capture elements 230 can be positioned generally on the inner boot 110. The tension capture element 230 can be attached to the reinforcement panel 225 positioned along one or more sides of the inner boot 110. Positioning the tension capture element 230 along the inner boot 110 generally can prevent the lace 320 tension from being affected by at least the movement and positioning of other parts of the boot system 100, such as the outer boot 105. It should be appreciated, however, that at least a part of the tension capture element 230 can be secured to the outer boot 105 without departing from the scope of the present disclosure.

Figure 6:
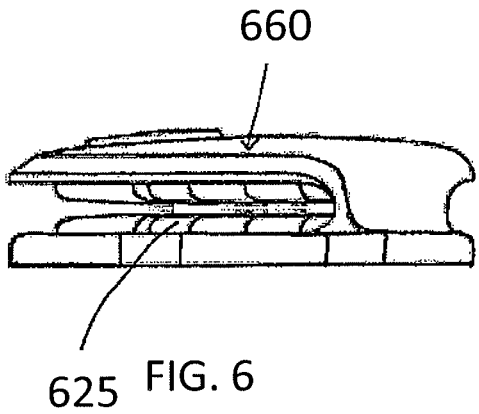
FIG. 6 shows a front view of an embodiment of a tension capture element.
Figure 7:
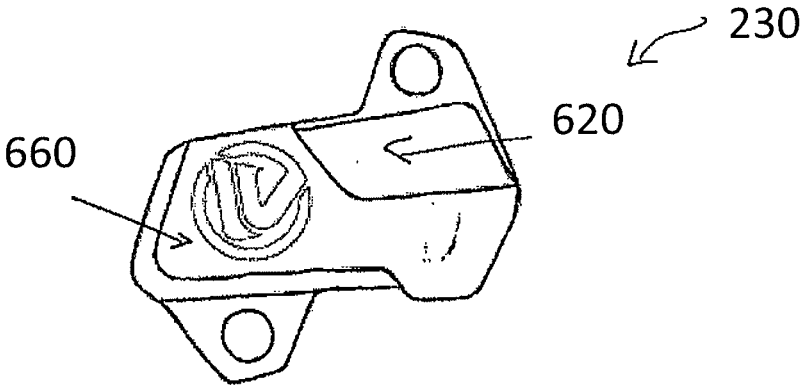
FIG. 7 shows a side view of the tension capture element of FIG. 6.
Figure 8:
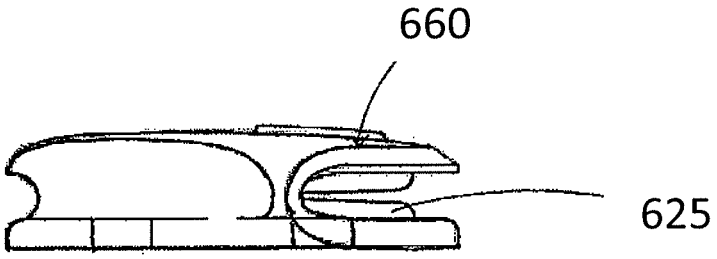
FIG. 8 shows a rear view of the tension capture element of FIG. 6.
Figure 9:
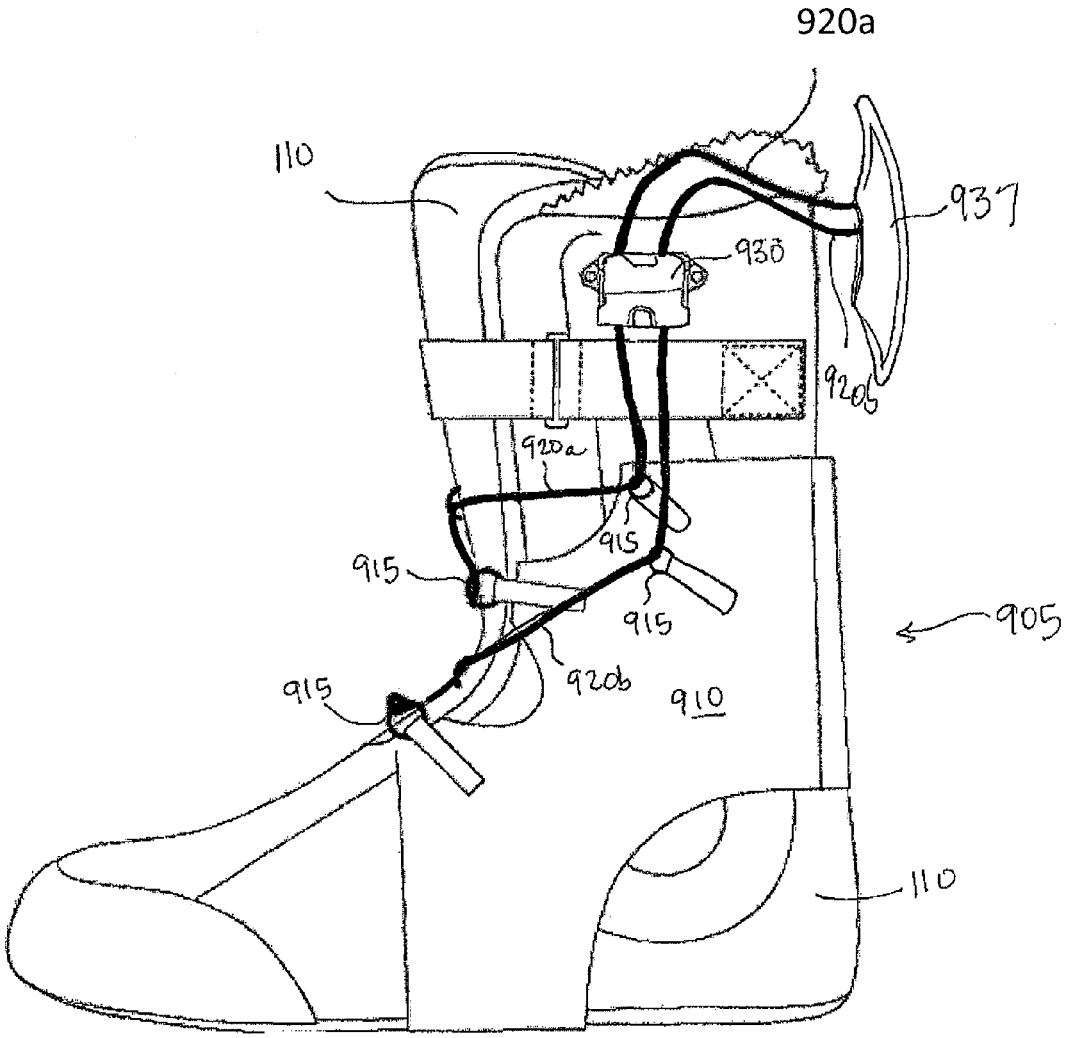
FIG. 9 shows a medial side view of an embodiment of a harness system surrounding the inner boot.

FIGS. 6-8 show an embodiment of a tension capture element 230. The lace 320 can extend from the harness system 305 and thread up through a channel 620 in the tension capture element 230 from an inferior end and out a superior end. The channel 620 can have a gripping surface 625 that can secure the lace 320 within the channel 620. In use, the user can pull proximally on the lace 320 until the desired closure force is achieved. The user can then rotate the portion of the lace 320 in hand into the gripping surface 625 of the tension capture element 230. The gripping surface 625 can be angled downward to generally assist in preventing the lace 320 from loosening. The lace 320 can be freed from the gripping surfaces 625 of the tension capture element 230 with a combined upward pull and forward rotation of the lace 320 freeing the lace 320 from the gripping surface 625 within the channel 620. Once the lace 320 is free from the tension capture element 230, the compression achieved by the panel 310 on the inner boot 110 can be adjusted. It should be appreciated that the lace 320 need not be freed from the gripping surfaces 625 in order to be tightened. Adding further tension to the lace 320 extending through the channel 620 is sufficient for additional compression to be applied.

In order to at least assist in aligning the lace 320 with the channel 620 of the tension capture element 230, an alignment feature such as a rivet 345 can be positioned adjacent the top end of at least one side of the panel 310 (see FIG. 4). For instance, the rivet 345 can be positioned such that it is generally vertically aligned with a capturing mechanism of a tension capture element 230 such that the lace 320 can readily extend vertically through the alignment feature 345 into the tension capture element 230. However, the alignment of the rivet 345 can be positioned in any number of configurations such that the lace 320 can be efficiently guided to and captured by the tension capture element 230 without departing from the scope of the present disclosure. In addition, although described herein as a rivet, any number of features can be used to align the lace 320 with the capturing mechanism of a tension capture element 230 without departing from the scope of the present disclosure.

The proximal end of the lace 320 can be provided with a gripping feature or handle 335 that can assist the user in at least locating and pulling on the lace 320 to exert tension and close the harness system 305 to the desired degree around the inner boot 110 and foot. The handle 335 can be sized and shaped such that a user can easily grasp and manipulate the handle 335 (i.e., pull the handle, store the handle after use, etc.) without needing to remove one or more gloves. Further, excess length of the lace 320 outside of the tension capture element 230 and/or the lace handle 335 can be stored within a feature, such as a pocket 350 (see FIG. 1), positioned on or in a portion of the boot system 100 to be securely positioned while not in use. The pocket 350 (FIG. 1) can be a low profiled feature such that the handle 335 can be discretely secured to the boot system 100. It should be appreciated that the excess free lace can be wrapped around at least a portion of the tension capture element 230 and/or handle 335 prior to tucking the handle 335 into the pocket 350 (FIG. 1). When sufficient length of the free lace 320 has been wrapped, the handle 335 can be inserted into the pocket 350 (FIG. 1). Little or no free hanging lace 320 is exposed to catching. It should be appreciated that although the pocket 350 is shown in the figures as being a part of the outer boot 105, that the inner boot 110 can include the pocket 350 for securing the lace 320 and/or lace handle 335.

As discussed above, the boot system 100 described herein is a generally flexible boot that allows the foot area of a user some flexion during use. As described above, a user may adjust the fit of the inner boot 110 by varying the lace 320 tension of the harness system 305 to provide a desired compression and support on the inner boot 110. Due, at least in part, to some of the boot system's flexion during use, the compression and support of the inner boot 110 may be reduced over time. When this occurs, a user may want to further tighten the harness system 305 in order to at least regain a desired fit. Alternatively, a user may be experiencing too much compression and/or support from the inner boot 110 and may want to alter the compression and support of the inner boot 110 in order to achieve a desired fit. The harness system 305 described herein allows a user to adjust the compression and fit of the inner boot 110 without requiring the outer boot 105 to be loosened or untied. As will be described in more detail below, the upper 125 of the outer boot 105 can include one or more features that provide a user with external access to the one or more tension capture elements 230 positioned on the inner boot 110 in order to adjust the tension on the harness system 305 and customize the fit of the inner boot 110 without needing to loosen the one or more securing systems 135 of the outer boot 105 or remove one's gloves.

As best shown in FIG. 1, the outer boot 105 of the boot system 100 can include at least one feature 505, such as an indentation, groove, depression, recess, cut-away, notch, V-shape, U-shape, or other shaped surface feature, positioned along an upper edge 510 region of the cuff that is at least partially complementary to and aligned in position with a lower edge region of the tension capture element 230 on the inner boot 110. The shape of the feature 505 and well as the position and number of features 505 can vary. In some embodiments, the feature 505 can be a shallow groove or indentation along the upper surface of the cuff. In other embodiments, the feature 505 can be a deeper, U-shaped cut-out in the cuff of the outer boot 105. The feature 505 prevents the cuff of the outer boot 105 from covering the tension capture element 230 of the inner boot 110 such that the tension capture element 230 remains externally accessible above the feature 505. In turn, the lace 320 extending through the channel 620 in the tension capture element 230 is more easily accessible by the user and the user is not required to manipulate the tension already applied to the cuff of the outer boot 105 by the securing system for the outer boot 105 to access and adjust the lace 320. The feature 505 provides a user with easy access to the tension capture element 230 positioned on the inner boot 110 external to the outer boot 105. Thus, although the tension capture element 230 can be positioned on the inner boot 110, it remains generally externally accessible and exposed by virtue of the feature 505 in the upper edge 510 of the cuff region of the outer boot 105. In turn, the user can access the tension capture element 230 to adjust the fit of the inner boot 110 and the harness system 305 without disturbing the securing system 135 of the outer boot 105. In addition, this complementary configuration between the tension capture element 230 and the feature 505 does not require the lace 320 of the harness system 305 or any other feature involved in the tensioning and closure of the system 100 to be fed through the outer boot 105, which could pose additional friction and interference to the lace 320. Further, the feature 505 prevents the outer boot 105 from putting pressure on the tension capture element 230, which could form an unwanted pressure point against the user.

FIGS. 9-13 illustrate a further implementation of a harness system 905 that can include a panel 910, a plurality of lacing elements 915 and a looped lace 920. The panel 910 can be sized and shaped as described above to assist the inner boot 110 by providing variable amounts of compression around at least a part of the inner boot and the user's foot area. The lacing elements 915 can be configured such that they slidably receive the lace 920 therethrough such that the lace 920 can be in sliding engagement with the lacing elements 915 of the panel 910 to provide variable amounts of compression around at least a part of the inner boot. The panel 910 can wrap around the inner boot 110 leaving a gap along the front of the inner boot 110 between opposing sides of the panel 910 (see FIG. 10). In this configuration, some of the plurality of lacing elements 915 can be positioned near an edge of the opposing sides of the panel 910 along the gap.

Figure 10:
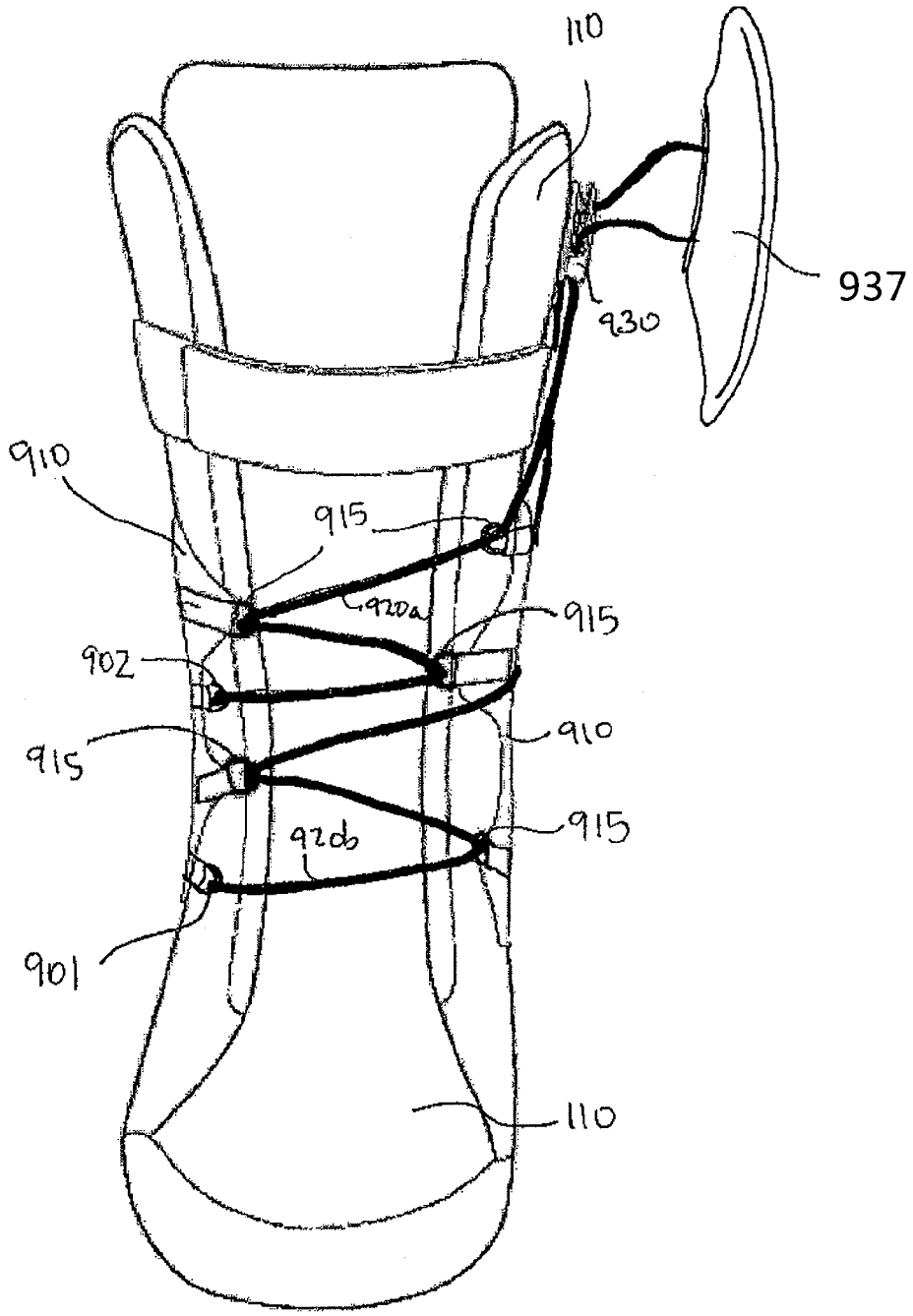
FIG. 10 shows a front view of the harness system of FIG. 9.

The looped lace 920 can be affixed at a first end 901 to one of the lacing elements 915 and affixed at a second, opposite end 902 to a different lacing element 915 and extend through at least one lacing element 915 on an opposite side of the gap (see FIG. 10). It should be appreciated that the fixation points of the ends 901, 902 can vary and that this is just one example of a lacing configuration. This dual-fixation of the lace 920 creates a loop 922 near a superior region of the harness system 905 (see FIG. 12) between a first lace portion 920*a* and a second lace portion 920*b*. The loop 922 can extend through a handle 937 as discussed below. The lace portions 920*a*, 920*b* help the user tighten the inner boot 110 more evenly across the forefoot and instep preventing heel lift. As each lace portion 920*a*, 920*b* is brought under increased tension, the harness system 905 can be used to apply increased amounts of compression to the inner boot 110. Each lace portion 920*a*, 920*b* can have a zigzag lacing configuration that allows an even closing or narrowing of the gap between the opposing sides of the panel 910 as each lace portion 920*a*, 920*b* is placed under tension, or increased tension. The zigzag lacing configuration of lace portions 920*a*, 920*b* can be off-set such that lace cross-over points are prevented.

One set of lacing elements 915 can be positioned near an upper portion of the panel 910 to slidably receive lace portion 920*a* such that the upper portion of the harness system 905 can be tightened by lace portion 920*a*. A second set of lacing elements 915 can be positioned near a lower portion of the panel 910 to slidably receive lace portion 920*b* such that the lower portion of the harness system 905 can be tightened by lace portion 920*b*. Upon applying tension to the loop 922 (such as by pulling the handle 937 if one is present), a user can apply tension to lace portion 920*b*, which can force lace portion 920*b* to pull the first set of lacing elements 915 on either side of the gap towards each other and tension the lower portion of the harness 905 and apply tension to lace portion 920*a*, which can force lace portion 920*a* to pull the second set of lacing elements 915 on either side of the gap towards each other and tension the upper portion of the harness 905. The gap G then narrows or closes and the harness system 905 increasingly applies compression to the inner boot 110 (see FIGS. 12 and 13).

Figure 11:
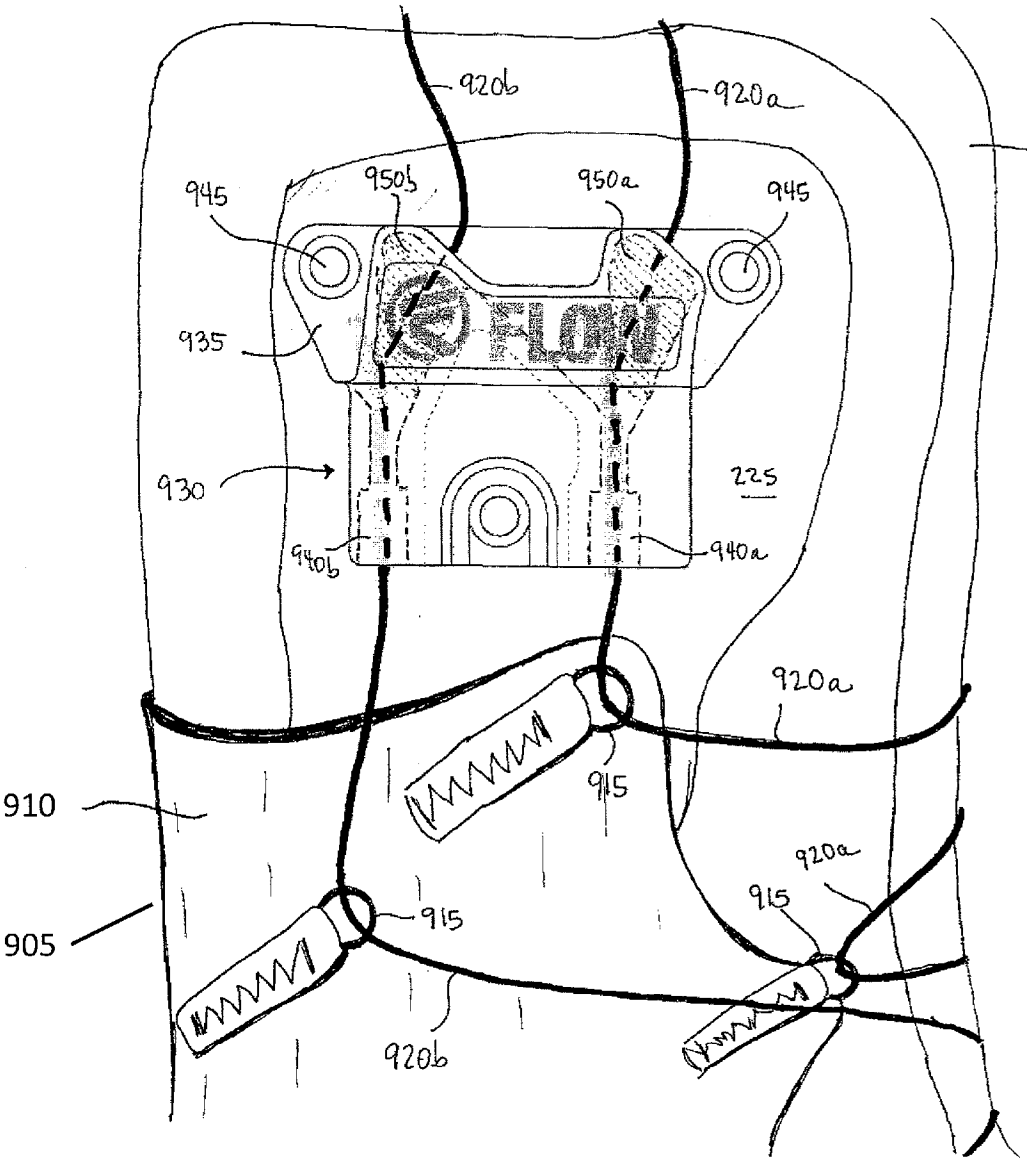
FIG. 11 shows a medial side close-up view of the harness system of FIG. 9.
Figure 12:
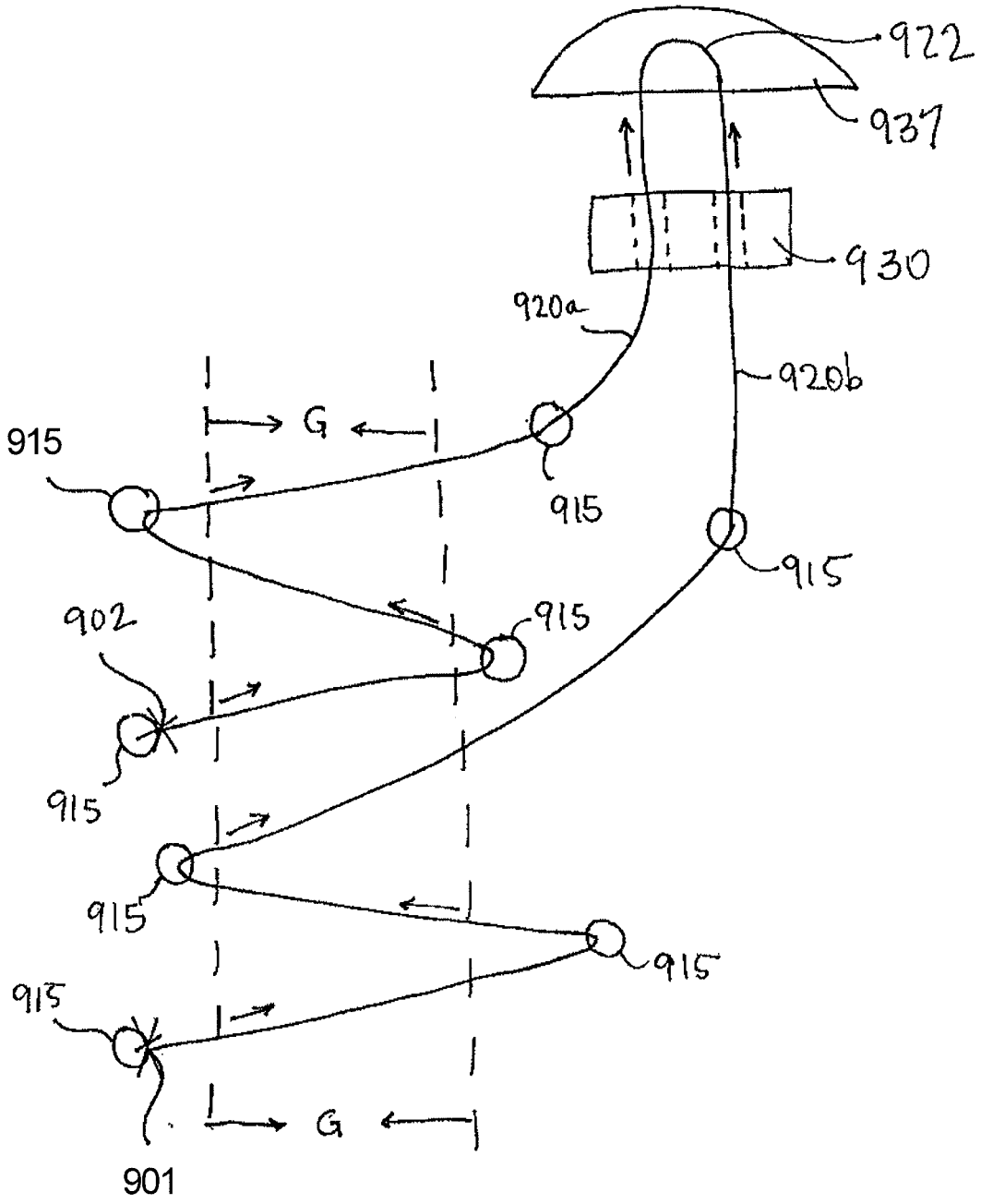
FIGS. 12 and 13 show tightening of the harness system using a loops lace.
Figure 13:
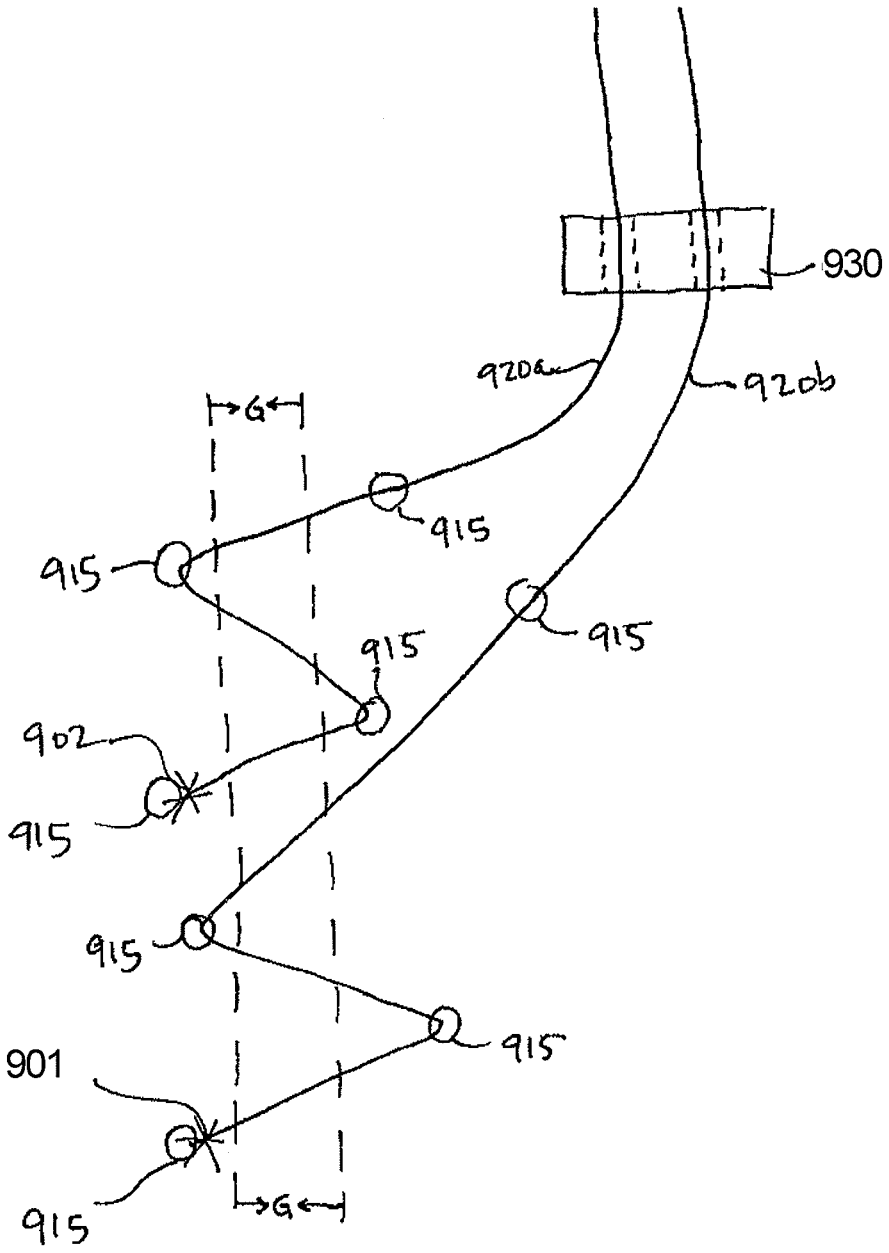

As shown in FIG. 11, each of the lace portions 920*a*, 920*b* can be extend through and be captured by one or more tension capture elements 930, such as a lace cleat. The tension capture element 930 can be positioned generally on the inner boot 110, such as on a medial side of the inner boot 110. The tension capture element 930 can be attached to a reinforcement panel 225 positioned along one or more sides of the inner boot 110. It should be appreciated that at least a part of the tension capture element 930 can be secured to the outer boot 105 without departing from the scope of the present disclosure.

Figure 15:
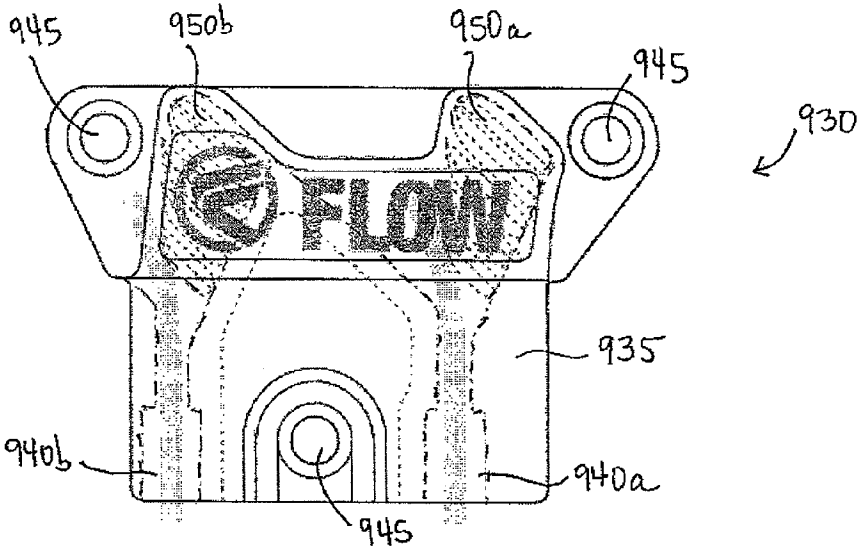
FIGS. 14, 15 and 16 show side, front and bottom views, respectively, of an embodiment of a tension capture element.
Figure 16:
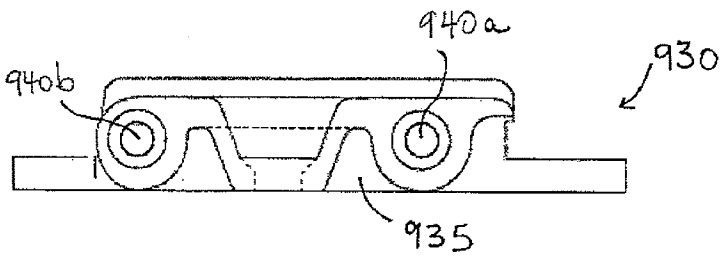
Figure 14:
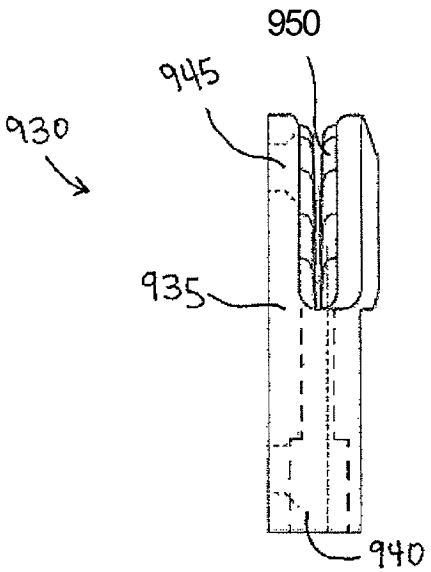

As best shown in FIGS. 14-16, the tension capture element 930 can include two tightening tracks that allow for each of the lace portions 920*a*, 920*b* to be locked down. It should be appreciated that the tightening tracks can be molded into a single element, such as one piece of injected plastic forming two tracks for the two lace portions 920*a*, 920*b*. Alternatively, the two lace portions 920*a*, 920*b* can be locked down using tightening tracks formed in separate tension capture elements 930. In some implementations, the tension capture element 930 can include a base 935 having a first tightening track 940*a* and a second tightening track 940*b* extending through the base 935. The base 935 can include one or more fixation apertures 945 through which a rivet or a screw can extend to fix the tension capture element 930 to the inner boot 110.

Lace portion 920*a* can extend from the harness system 905 and thread up through the first tightening track 940*a* in the tension capture element 930 from an inferior end and out a superior end. The first tightening track 940*a* can have a gripping surface 950*a* near a superior end of the tension capture element 930 that can secure lace portion 920*a* within the tension capture element 930. Lace portion 920*b* can extend from the harness system 905 and thread up through the second tightening track 940*b* in the tension capture element 930 from an inferior end and out a superior end. The second tightening track 940*b* can have a gripping surface 950*b* near a superior end of the tension capture element 930 that can secure lace portion 920*b* within the tension capture element 930. In use, the user can pull proximally on one or both of the lace portions 920*a*, 920*b* until the desired closure force is achieved. The lace portions 920*a*, 920*b* can be attached to a handle 937. In some implementations, the loop 922 can extend through the handle 937 (see FIG. 12).

The user can then rotate a portion of one or both of the lace portions 920*a*, 920*b* into the gripping surfaces 950*a*, 950*b* of the tension capture element 930. The gripping surfaces 950*a*, 950*b* can be angled downward to generally assist in preventing the lace portions 920*a*, 920*b* from loosening. The lace portions 920*a*, 920*b* can be freed from the gripping surfaces 950*a*, 950*b* of the tension capture element 930 with a combined upward pull and forward rotation of the lace portions 920*a*, 920*b* freeing them from the gripping surfaces 950*a*, 950*b* within the tracks 940*a*, 940*b*. Once the lace portions 920*a*, 920*b* are free from the tension capture element 930, the compression achieved by the panel 910 on the inner boot 110 can be adjusted. It should be appreciated that one or both of the lace portions 920*a*, 920*b* need not be freed from the gripping surfaces 950*a*, 950*b* in order to be tightened. Adding further tension to the lace portions 920*a*, 920*b* extending through the tracks 940*a*, 940*b* is sufficient for additional compression to be applied.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

What is claimed is:

1. A boot system comprising:

an outer boot comprising a securing system and a superior end that includes a cuff;

an inner boot sized to fit between the outer boot and a foot area of a user inserted in the boot system, wherein the inner boot comprises a tension capture element positioned generally on an upper, cuff end of the inner boot; and a harness system comprising a flexible panel and a lace slidably engaged with the panel, the lace affixed to the panel at a first end;

wherein the harness system is removably secured to the outer boot, and the tension capture element comprises:

a first tightening track configured to lock down a first lace portion;

a second tightening track configured to lock down a second lace portion;

a first gripping surface configured to secure the first lace portion in the first tightening track, the first gripping surface angled downward to prevent the first lace portion from loosening and wherein the first gripping surface is configured to release the first lace portion from the tension capture element with a combined upward pull and forward rotation of the first lace portion; and a second griping surface configured to secure the second lace portion in the second tightening track, the second gripping surface angled downward to prevent the second lace portion from loosening and wherein the second gripping surface is configured to release the second lace portion from the tension capture element with a combined upward pull and forward rotation of the second lace portion.

2. The boot system of claim 1, wherein the harness system is further removably secured to at least a part of the inner boot.

3. The boot system of claim 1, wherein the panel of the harness system wraps about at least a part of the inner boot.

4. The boot system of claim 3, wherein the harness system provides variable amounts of compression around the at least a part of the inner boot upon sliding engagement of the lace with the panel.

5. The boot system of claim 3, wherein the panel discontinuously wraps about the at least a part of the inner boot and forms at least one gap in the panel.

6. The boot system of claim 5, wherein the harness system comprises a first lacing element disposed on a first side of the at least one gap and a second lacing element disposed on a second, opposite side of the at least one gap, wherein the first and second lacing elements have an alignment that is horizontally off-set.

7. The boot system of claim 6, wherein the lace extends sequentially through the first and second lacing elements and forms a zigzag configuration relative to the panel.

8. The boot system of claim 6, wherein application of tension to the lace forces the at least one gap to narrow.

9. The boot system of claim 6, wherein the harness system further comprises a third lacing element disposed on the first side of the at least one gap and a fourth lacing element disposed on the second, opposite side of the at least one gap, wherein the third and fourth lacing elements have an alignment that is horizontally off-set from one another and from the first and second lacing elements.

10. The boot system of claim 9, wherein the lace extends sequentially through the third and fourth lacing elements and forms a zigzag configuration relative to the panel.

11. The boot system of claim 9, wherein application of tension to the lace forces the at least one gap to narrow.

12. The boot system of claim 9, wherein the lace comprises a single looped lace anchored to the panel at the first end and anchored to the panel at a second, opposite end forming a first lace portion and a second lace portion, the first lace portion capable of being tensioned independent of the second lace portion and the second lace portion cable of being tensioned independent of the first lace portion.

13. The boot system of claim 12, wherein the first lace portion forces an upper portion of the at least one gap to narrow and the second lace portion forces a lower portion of the at least one gap to narrow.

14. The boot system of claim 12, wherein the single looped lace loops through a handle at an upper, cuff end of the harness system.

15. The boot system of claim 12, wherein the first and second lace portions extend through and are releasably secured to a portion of the tension capture element.

16. The boot system of claim 15, wherein the tension capture element comprises a first and a second tightening track.

17. The boot system of claim 16, wherein the first tightening track captures the first lace portion and the second tightening track captures the second lace portion.

18. The boot system of claim 16, wherein the first and second tightening tracks are molded into a single tension capture element.

19. The boot system of claim 18, wherein the single tension capture element is coupled to the inner boot by at least one fixation element extending through a corresponding aperture.

20. The boot system of claim 1, wherein the tension capture element positioned generally on the upper, cuff end of the inner boot is positioned on at least one of a medial side and a lateral side of the inner boot.

21. The boot system of claim 20, wherein the tension capture element is accessible external to the outer boot without adjusting the securing system of the outer boot.

* * * * *

UNITED STATES PATENT AND TRADEMARK OFFICE

CERTIFICATE OF CORRECTION

PATENT NO. : 9,125,450 B2
APPLICATION NO. : 13/315204
DATED : September 8, 2015
INVENTOR(S) : Alex Zhao et al.

It is certified that error appears in the above-identified patent and that said Letters Patent is hereby corrected as shown below:

Specification

In column 3, line 11, “harness system of FIG. 3” should be --harness system of FIG. 4--.

In column 8, line 18, “distal and to the” should be --distal end to the--.

Claims

In column 14, line 47, In claim 12, “second lace portion cable” should be --second lace portion capable--.

Signed and Sealed this
Ninth Day of February, 2016

Michelle K. Lee

Michelle K. Lee
*Director of the United States Patent and Trademark Office*